US006393991B1

(12) United States Patent
Funston et al.

(10) Patent No.: US 6,393,991 B1
(45) Date of Patent: May 28, 2002

(54) K-CHARGE—A MULTIPURPOSE SHAPED CHARGE WARHEAD

(75) Inventors: Ronald J. Funston, Stonyford; Kjell V. Mattsson, Oakland; Neal N. Ouye, Berkeley, all of CA (US)

(73) Assignee: General Dynamics Ordnance and Tactical Systems, Inc., St. Petersburg, FL (US)

( * ) Notice: Subject to any disclaimer, the term of this patent is extended or adjusted under 35 U.S.C. 154(b) by 0 days.

(21) Appl. No.: 09/592,826

(22) Filed: Jun. 13, 2000

(51) Int. Cl.[7] ..... F42B 12/10
(52) U.S. Cl. ..... 102/476; 102/306
(58) Field of Search ..... 102/306, 307, 102/309, 310, 475, 476

(56) References Cited

U.S. PATENT DOCUMENTS

| | | | | | |
|---|---|---|---|---|---|
| 3,451,339 | A | | 6/1969 | Precoul | 102/56 |
| 3,658,007 | A | | 4/1972 | Bucklisch | 102/24 |
| 3,948,181 | A | | 4/1976 | Bergstrom | 102/56 |
| 4,594,947 | A | * | 6/1986 | Aubry et al. | 102/307 |
| 4,612,859 | A | | 9/1986 | Furch et al. | 102/476 |
| 4,672,896 | A | | 6/1987 | Precoul et al. | 102/309 |
| 4,766,813 | A | | 8/1988 | Winter et al. | 102/307 |
| 4,875,414 | A | | 10/1989 | Stadler et al. | 102/307 |
| 4,892,039 | A | | 1/1990 | Emerson et al. | 102/476 |
| 4,896,609 | A | * | 1/1990 | Betts et al. | 102/309 |
| 4,942,819 | A | * | 7/1990 | Thoma et al. | 102/476 |
| H913 | H | | 5/1991 | Hershkowitz | 102/307 |
| 5,191,169 | A | * | 3/1993 | Hu | 102/476 |
| 5,204,493 | A | * | 4/1993 | Christmann et al. | 102/307 |
| 5,237,929 | A | | 8/1993 | Ekholm | 102/476 |
| 5,251,561 | A | * | 10/1993 | Murphy | 102/307 |
| 5,259,317 | A | * | 11/1993 | Lips | 102/307 |
| 5,279,228 | A | | 1/1994 | Ayer | 102/306 |
| 5,322,020 | A | | 6/1994 | Bernard et al. | 102/476 |
| H1504 | H | * | 12/1995 | Crabtree | 102/476 |
| 5,565,644 | A | * | 10/1996 | Chawla | 102/307 |
| 5,656,791 | A | * | 8/1997 | Reese et al. | 102/307 |
| 5,939,663 | A | | 8/1999 | Walters et al. | 102/476 |
| 6,021,714 | A | * | 2/2000 | Grove et al. | 102/307 |
| 6,026,750 | A | * | 2/2000 | Nelson | 102/476 |

OTHER PUBLICATIONS www.dera.gov.uk/html/who_are/history/challenger.htm, Challenger tank and Chobham armour, 10/99.
www.army–technology.com/projects/javelin/index.html, Javelin—Anti–Armour Missile, 10/99.

* cited by examiner

*Primary Examiner*—Charles T. Jordan
*Assistant Examiner*—Kimberly S. Smith
(74) *Attorney, Agent, or Firm*—Gregory S. Rosenblatt; Wiggin & Dana

(57) ABSTRACT

A multipurpose warhead utilizes a shaped charge device with a shaped charge liner having an included angle in excess of 70° sealing an internal cavity that contains an explosive. A detonatior system having a selectable plurality of outputs contacts the explosive. Peripheral detonation of the explosive generates a high speed, small diameter, penetrating jet that typically includes about 90% of the liner mass. Central point source detonation of the explosive generates a larger diameter, slower moving, explosively formed penetrator. A combination of plural peripheral point detonation and central point source detonation generates multiple fragments. An ability to select detonation type in the field enables a single warhead to be effective against multiple target types. The shaped charge liner may optionally be a composite material having a jet forming portion and an effect forming portion.

23 Claims, 18 Drawing Sheets

105° VARIABLE WALL Mo TULIP LINER, L/D=0.7 EQUIVALENT
20 CD JET CHARACTERIZATION X-RAY FOR 120mm K-CHARGE

JET VELOCITIES FOR 120mm MP CHARGE, SINGLE POINT INITIATION

20 CD JET CHARACTERIZATION X-RAY FOR 120mm MP CHARGE, SINGLE POINT CENTER INITIATION

20 CD JET CHARACTERIZATION X-RAY FOR 106mm K-CHARGE, AMBIENT TEMPERATURE

K-CHARGE— A MULTIPURPOSE SHAPED CHARGE WARHEAD

BACKGROUND

1. Field of the Invention

This invention relates to a shaped charge warhead. More particularly, the method of detonating the warhead is selected in the battlefield, thereby enabling selection of an expelled projectile selected from the group that includes penetrating jets, explosively formed penetrators and multiple fragments. The ability to select an expelled projectile type enables a single warhead, using a single liner and explosive configuration, to be effective against a number of different targets.

2. Description of Related Art

Shaped charge warheads have proven useful against targets having rolled 15 homogeneous steel armor (RHA), such as tanks. Detonation of the shaped charge warhead forms a small diameter molten metal elongated cylinder, referred to as a penetrating jet, that travels at a speed that typically exceeds 10 kilometers per second. The high velocity of the jet coupled with the high density of the metal forming the jet enables the jet to penetrate RHA. The jet then typically dissipates any remaining momentum as multiple fragments within the tank enclosure, thereby disabling the tank.

While useful against RHA, high velocity penetrating jets are less effective against lightly armored targets, such as troop carriers. The high speed jet pierces a wall of the target and, unless the jet strikes an object within the target, exits through the other side causing minimal damage. Likewise, the high velocity penetrating jets are of limited value against a target having few vulnerable points, such as a radar installation.

Recognizing the vulnerability of RHA to high velocity penetrating jets, defensive armor has been developed. Composite armor is one type of defensive armor. Composite armor has a multilayer structure with layers formed from materials of different densities and different relative hardnesses. For example, one layer may be RHA and an adjacent layer a ceramic or a polymeric rubber. As a high velocity jet passes through layers of different densities and different relative hardnesses, the speed of the front end of the jet changes and disruptive shock waves may form. Composite armor is intended to cause early breakup of the penetrating jet, before the penetrating jet breaches the armor.

A second type of defensive armor employs armor plates disposed at a non-normal angle relative to the likely trajectory of the penetrating jet. When the jet impacts the angled armor, the trajectory is disrupted reducing the depth of jet penetration into the armor.

Projectiles to defeat lightly armored vehicles and installations with few points of vulnerability are known. Each target type has special requirements. For example, an explosively formed penetrator (EFP) is useful against a lightly armored target. An explosively formed penetrator is formed from a shaped charge warhead having a different liner configuration than used to form a penetrating jet. The formed EFP has a larger diameter, a shorter length and a slower speed than a high velocity penetrating jet. The explosively formed penetrator is more likely to remain within the confines of the target causing increased damage.

Multiple fragments are useful against an installation with few points of vulnerability. The multiple fragments increase the odds that a vulnerability point, such as an electronic component, will be damaged.

U.S. Pat. No. 5,237,929 discloses that liner shape can influence whether a penetrating jet or a slug is formed. Generally, the smaller the included angle of the shaped charge liner, the more the projectile will have the characteristics of a penetrating jet. The larger that included angle, the more likely the characteristics will be that of an explosively formed penetrator.

U.S. Pat. No. 4,612,859 discloses that different types of targets may be faced in the battlefield and provides a multipurpose warhead having, in tandem, three separate warheads. Each warhead has a single function and is useful against a different type target.

One portable weapon that utilizes shaped charge warheads is an anti-tank weapon known as Javelin. The Javelin was developed and is manufactured by Raytheon/Lockheed Martin Javelin Joint Venture of Lewisville, Tex. and Orlando, Fla. The weapon has a nominal carry weight of 22.3 kilograms and is a shoulder-fired weapon that can also be installed on tracked, wheeled or amphibious vehicles.

While the Javelin and other such portable weapons are capable of firing a shaped-charge warhead, frequently the target that will be encountered in the battlefield is not known at the beginning of a mission. This requires troops to carry multiple types of warheads undesirably increasing the transported weight. Likewise, incorporating multiple warheads into a single multipurpose warhead undesirably increases both the warhead length and weight.

Accordingly, there remains a need for a single multipurpose warhead that is capable of defeating a variety of targets, that utilizes a single liner and explosive configuration and that may be selectively programmed in the field.

SUMMARY OF THE INVENTION

Accordingly, it is an object of the invention to provide a multipurpose warhead that utilizes a single liner and explosive configuration, and that is capable of defeating a number of different types of targets. It is a feature of the invention that the multipurpose warhead utilizes a shaped charge device having a plurality of detonation sites. By proper selection of the detonation sites, the type of projectile expelled from the shaped charge device may be selectively varied. It is another feature of the invention that the length of the shaped charge device is less than its diameter resulting in a compact, light weight, warhead that utilizes a single liner and explosive configuration and is easily transportable. Still another feature of the invention is that the multipurpose warhead is useful with portable, hand-held weapons.

Among the advantages of the multipurpose warhead of the invention is that a single warhead may be used against a variety of armor types and a variety of targets. As a result, troops need carry only one type of light-weight warhead, reducing the weight penalty imposed on the troops.

In accordance with the invention, there is provided a multipurpose charge for a warhead. The charge includes a housing having an open end and a closed end with sidewalls disposed therebetween. A jet producing liner closes the open end. The housing and the jet producing liner in combination define an internal cavity. An initiating explosive is housed within this internal cavity and located adjacent to the closed end. A primary explosive is disposed within the internal cavity and disposed between the jet producing liner and the initiating explosive. Contacting the primary explosive is a first detonator effective for single point detonation of the primary explosive and a second detonator effective for multipoint peripheral detonation of the primary explosive.

The above-stated objects' features and advantages will become more apparent from the specification and drawings that follow.

IN THE DRAWINGS

Figure 7:
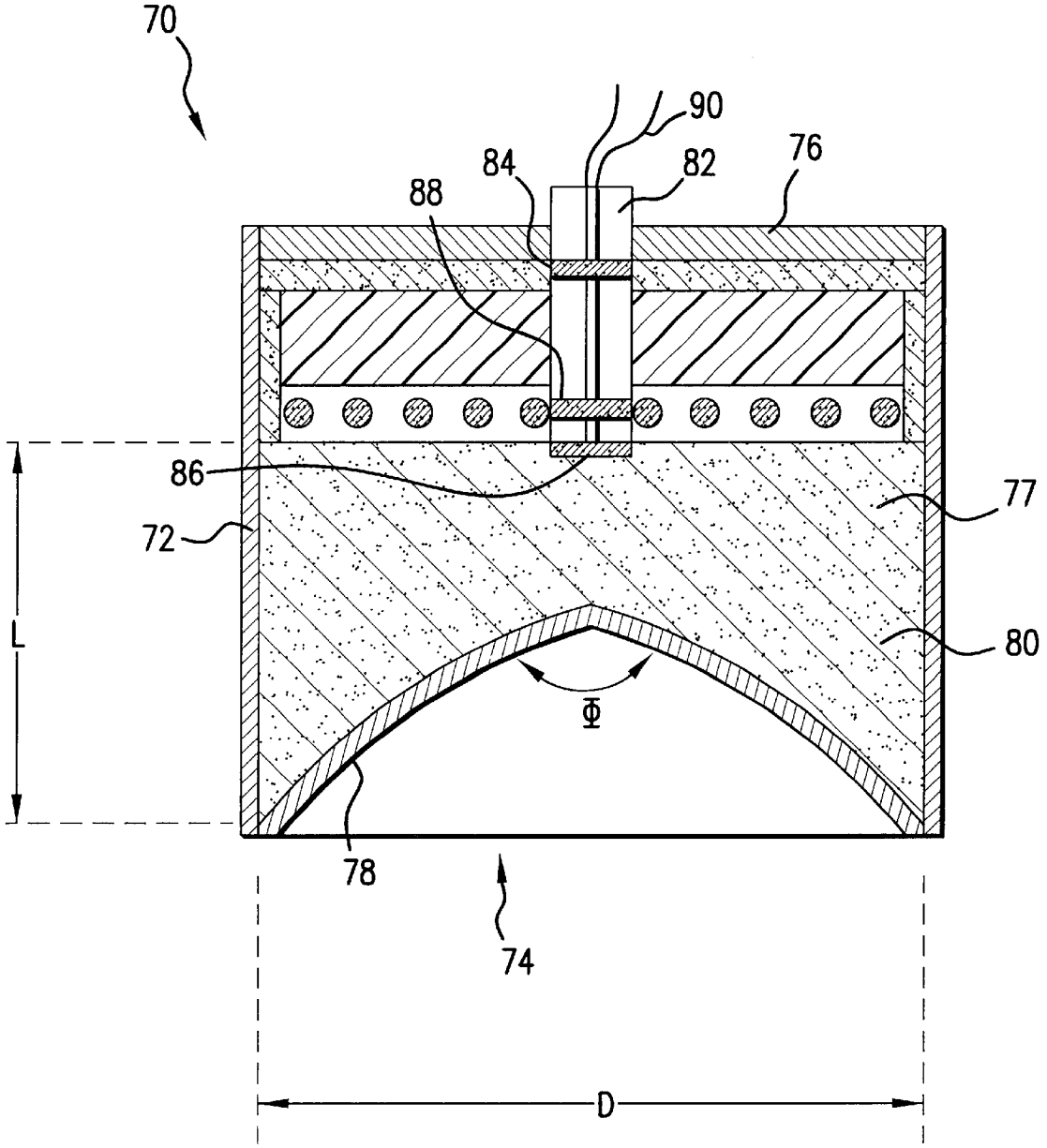
FIG. 7 illustrates a shaped charge device in accordance with the present invention.
Figure 12A:
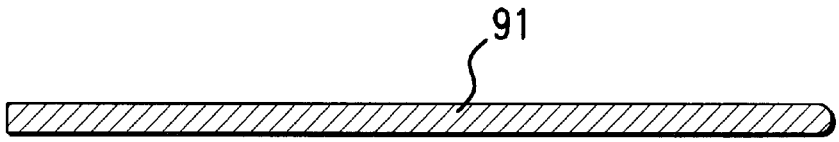
Figure 12B:
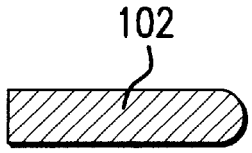
Figure 12C:
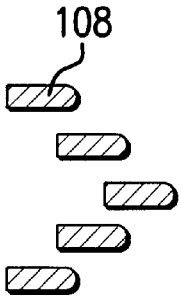

FIGS. 12*a*–12*c* illustrate projectile types formed from the shaped charge device of FIG. 7.

Figure 13:
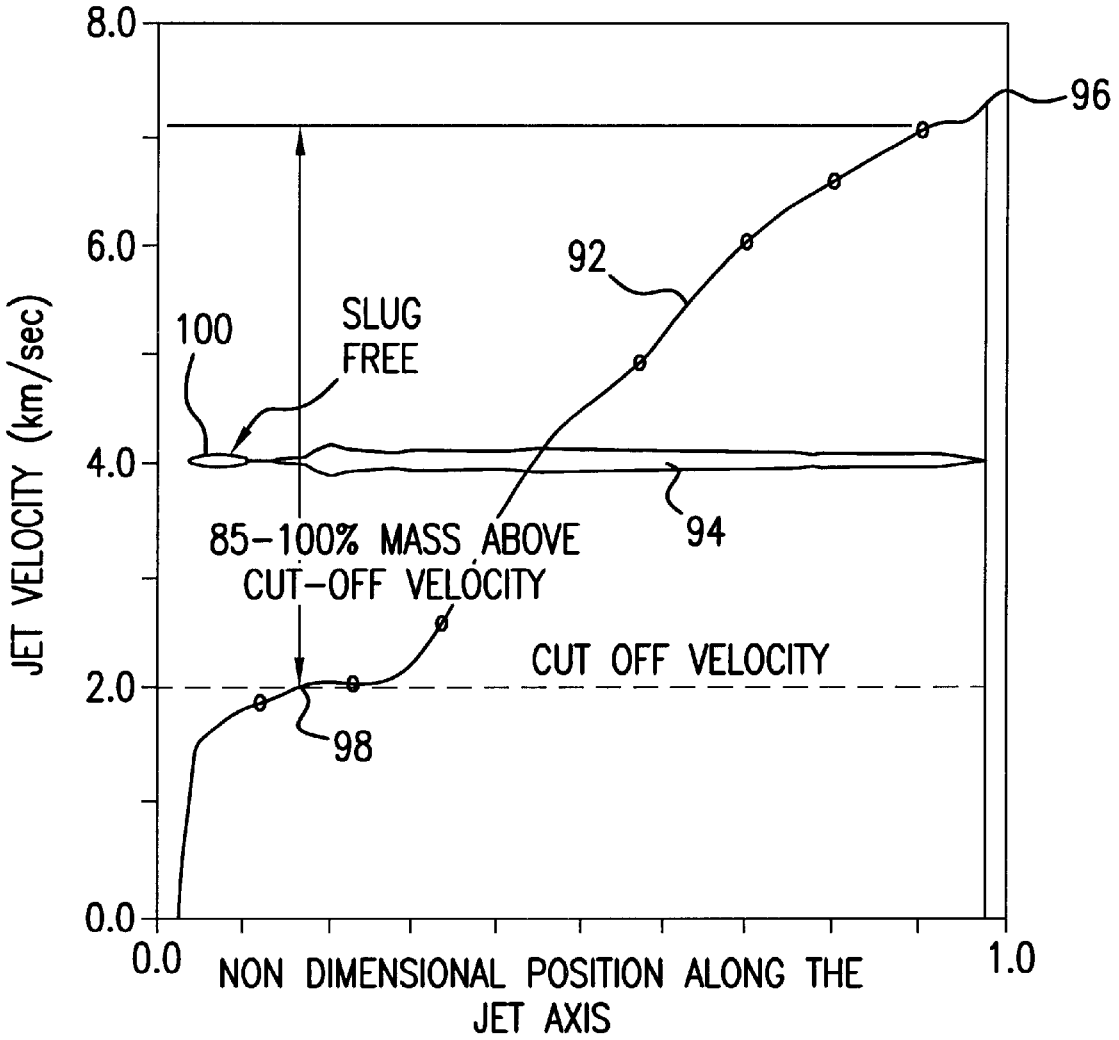

FIG. 13 graphically illustrates the penetrating jet profile achieved from the device of FIG. 7 utilizing peripheral detonation.

Figure 14:
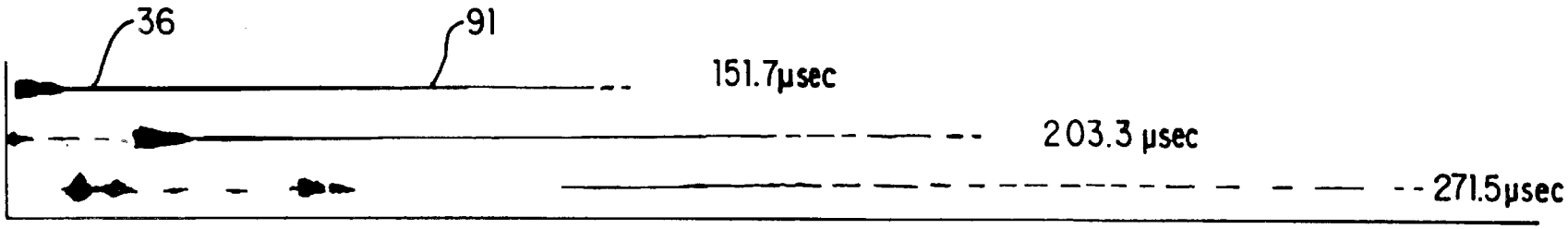

FIG. 14 is an x-ray image of the penetrating jet of FIG. 13 as a function of time.

Figure 15:
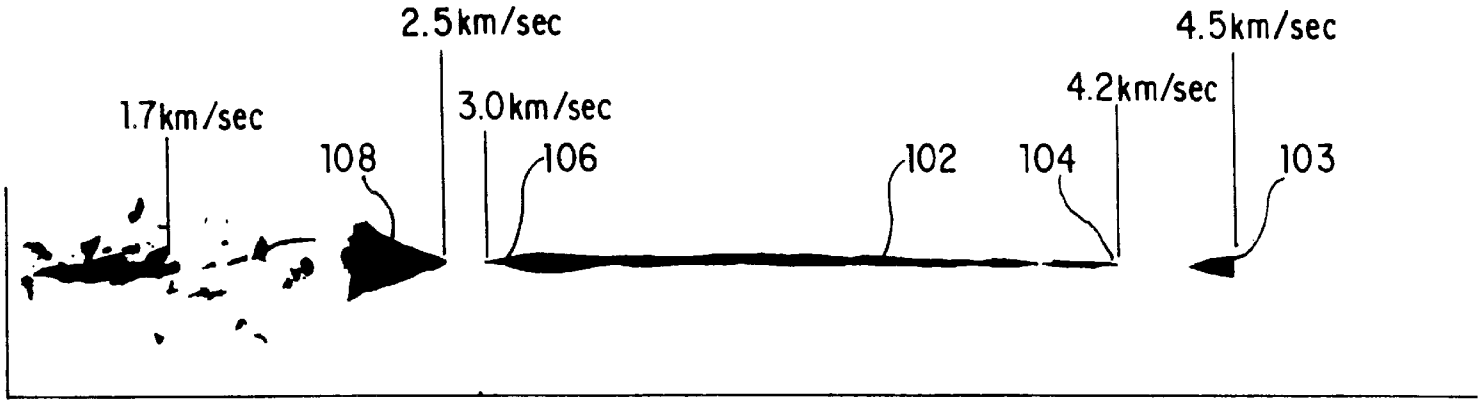

FIG. 15 is an x-ray image of an explosively formed penetrator formed from the device of FIG. 7 utilizing single point detonation.

Figure 16:
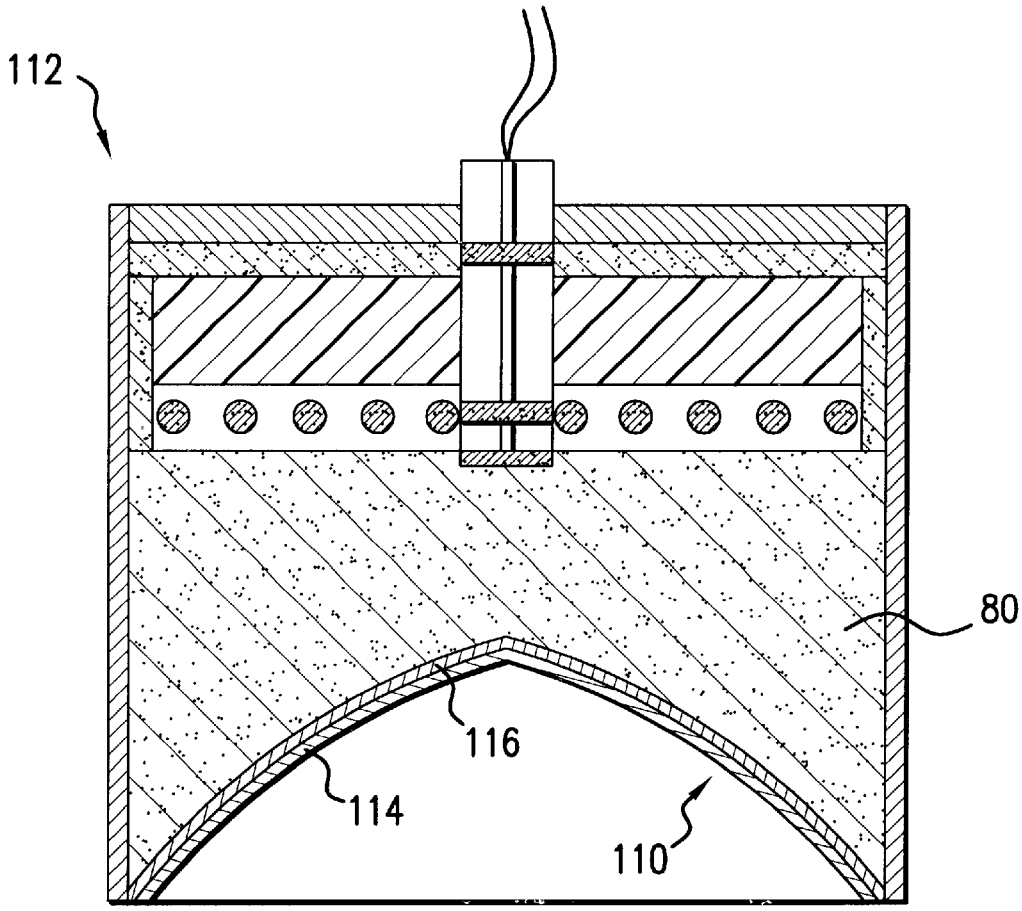

FIG. 16 illustrates in cross-sectional representation an alternative embodiment of the shaped charge device of the invention including a composite liner.

Figure 17:
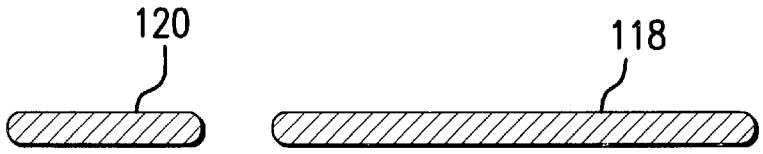

FIG. 17 illustrates a projectile formed from the composite liner of the shaped charge device of FIG. 16.

Figure 18:
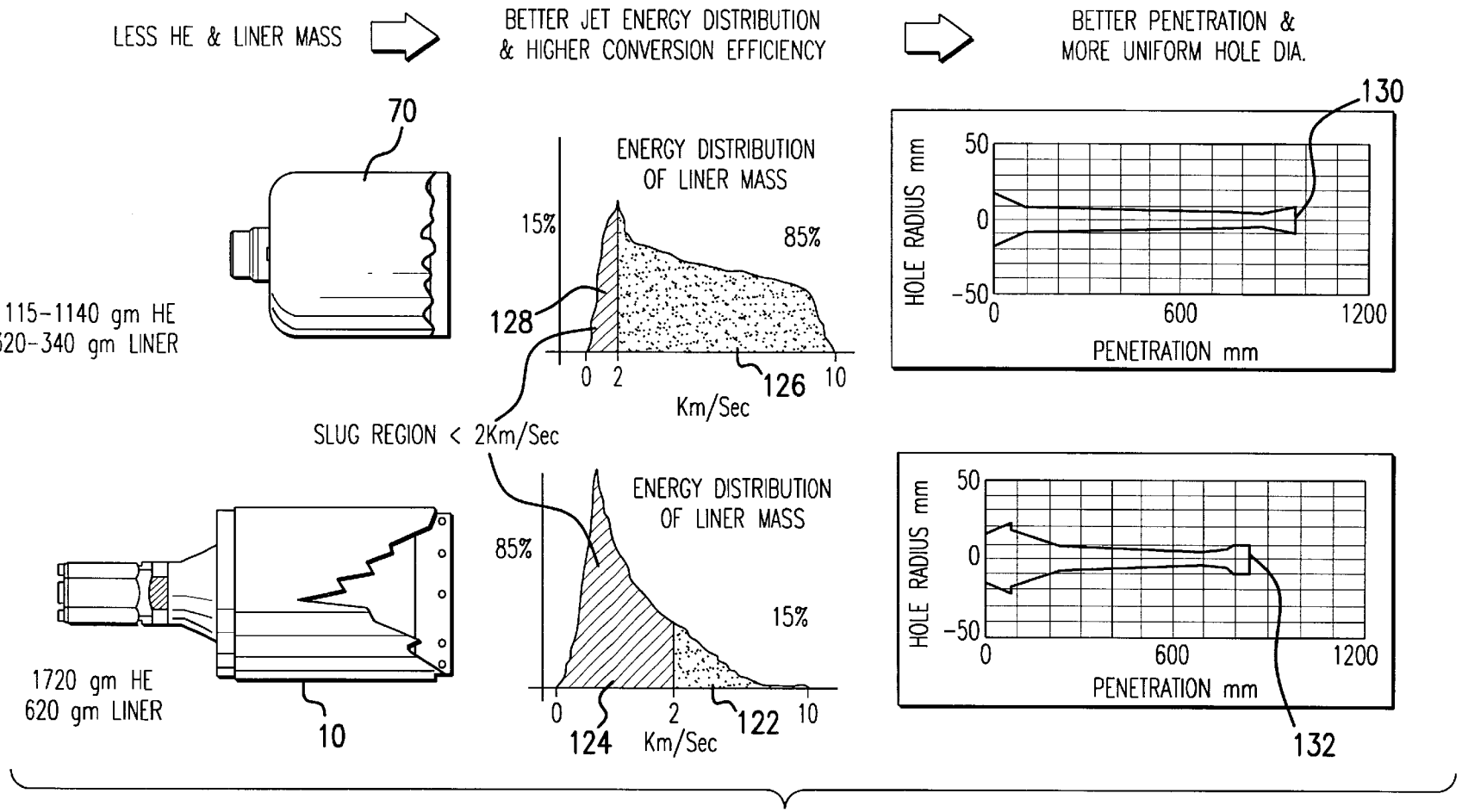

FIG. 18 graphically compares the weight and performance of the shaped charge devices of the present invention with a conventional shaped charge device.

Figure 19:
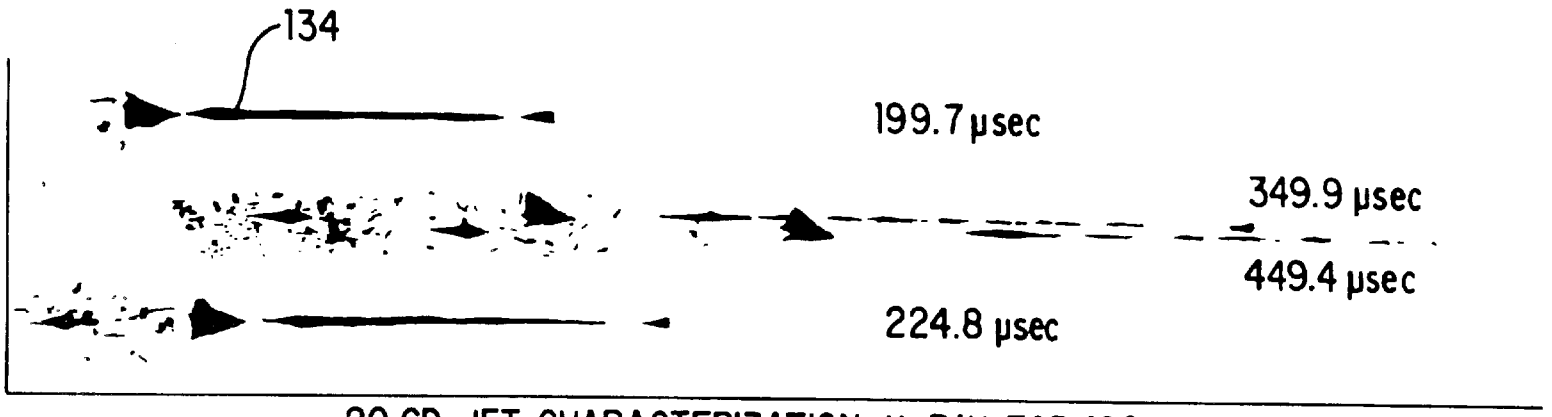

FIG. 19 is an x-ray image of an explosively formed penetrator formed in accordance with the invention as a function of time.

Figure 20:
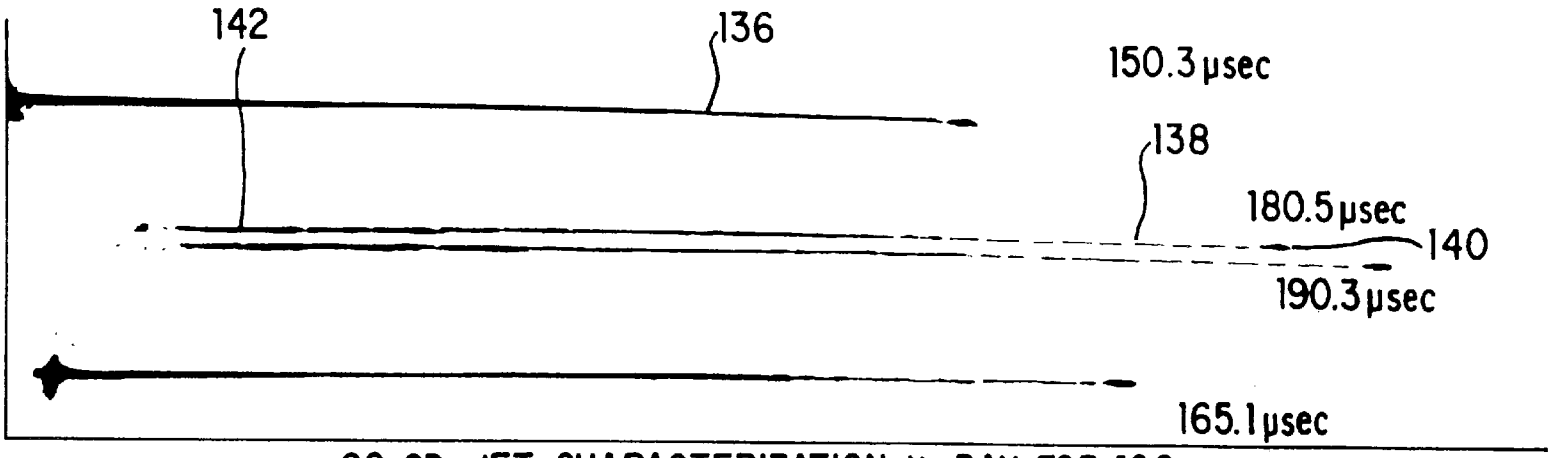

FIG. 20 is an x-ray image of a penetrating jet formed from the shaped charge device of the present invention as a function of time.

Figure 21:
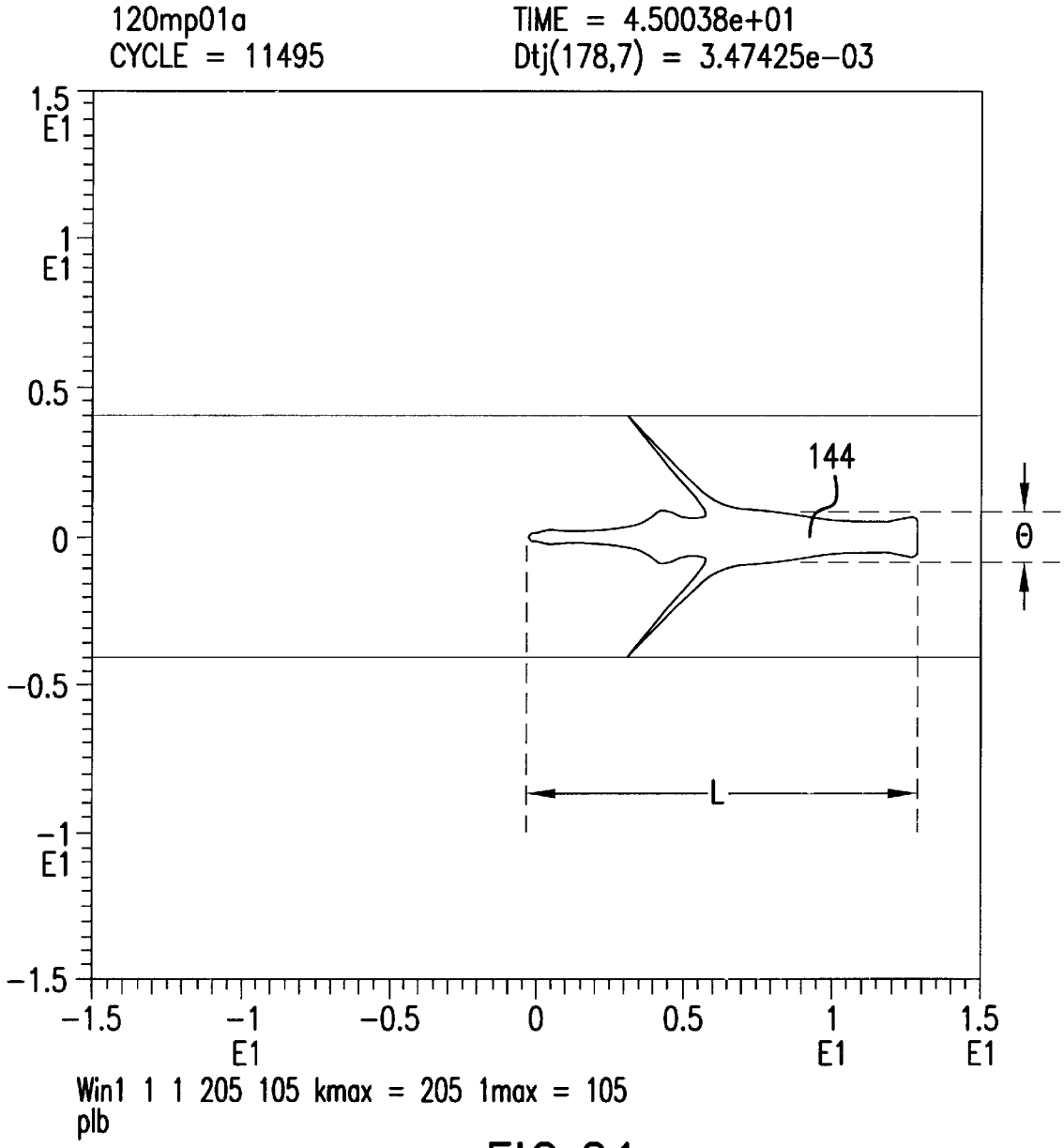

FIG. 21 illustrates the jet profile for an explosively formed penetrator of the present invention.

Figure 22:
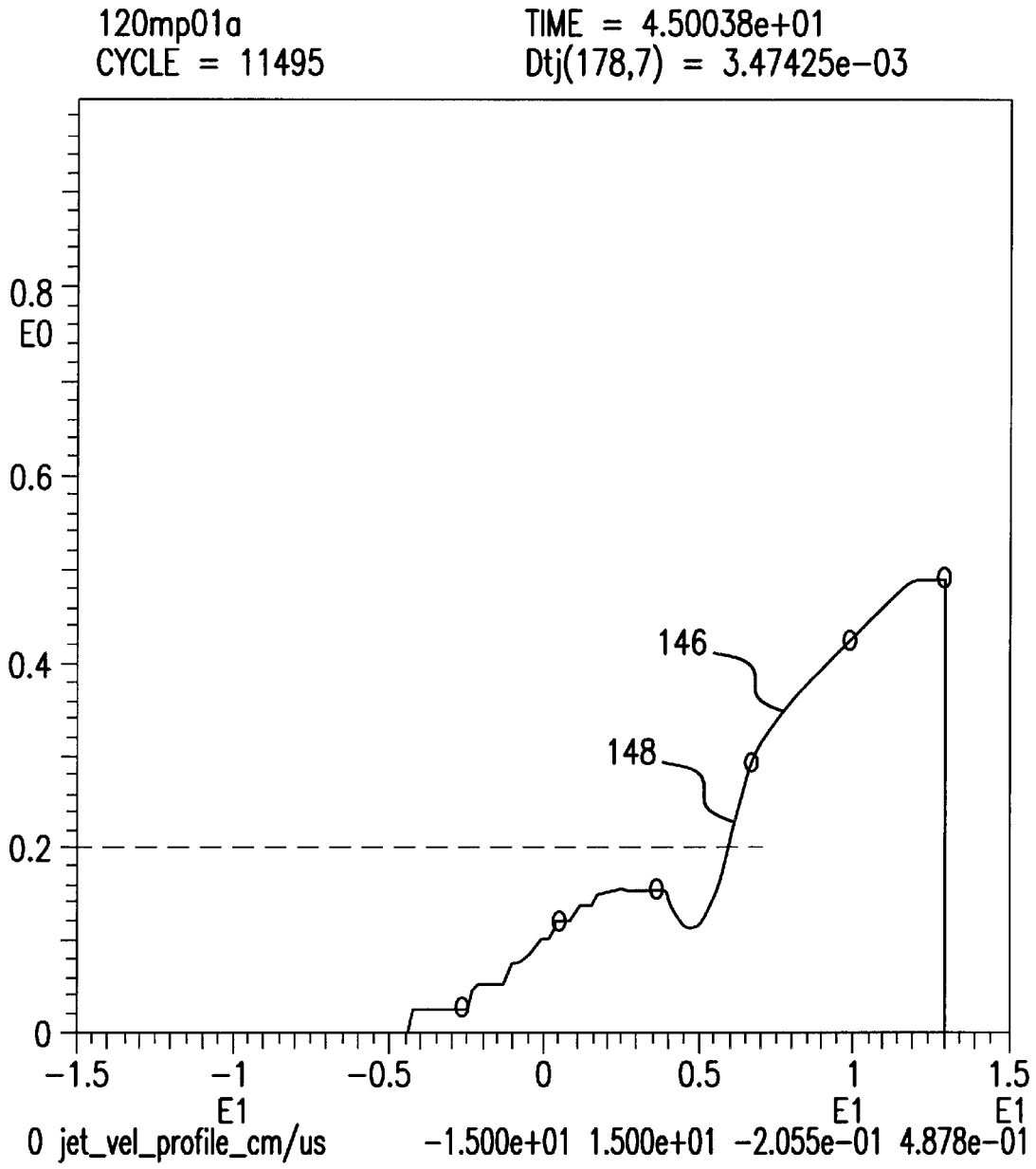

FIG. 22 graphically illustrates the velocity profile for the explosively formed penetrator of the present invention.

Figure 23:
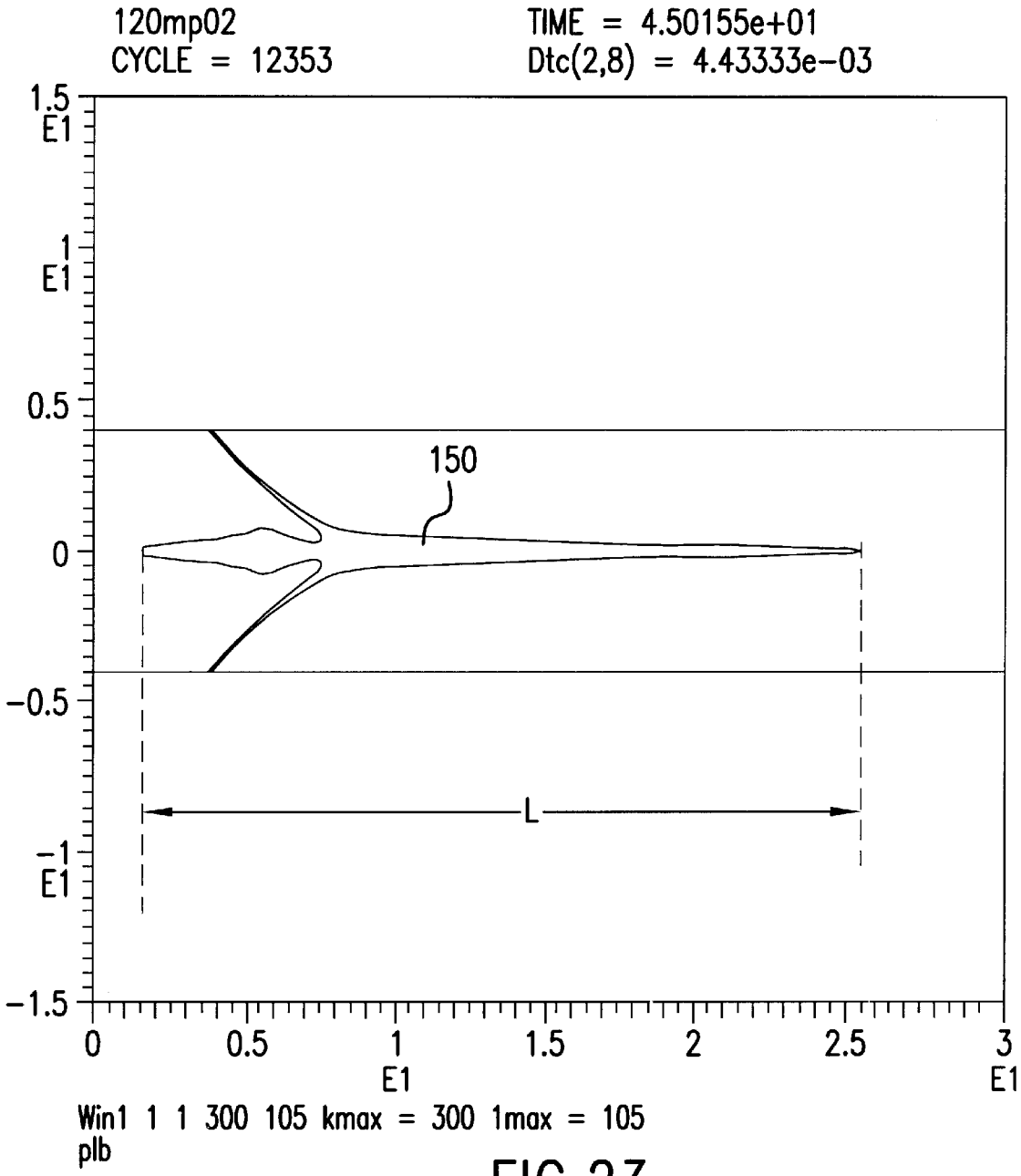

FIG. 23 graphically illustrates the jet profile for a penetrating jet of the present invention.

Figure 24:
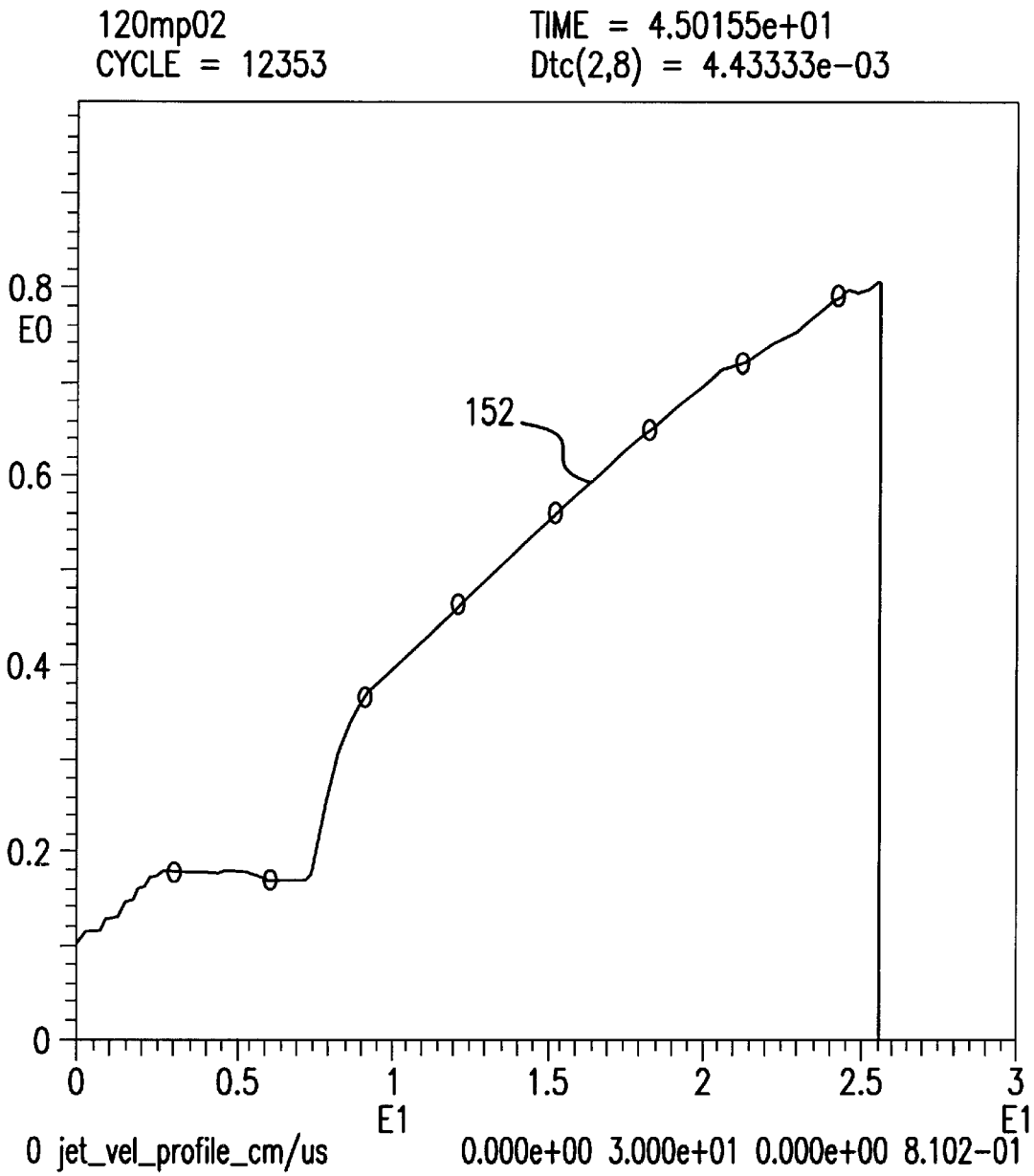

FIG. 24 graphically illustrates the velocity profile for the penetrating jet of the present invention.

Figure 25:
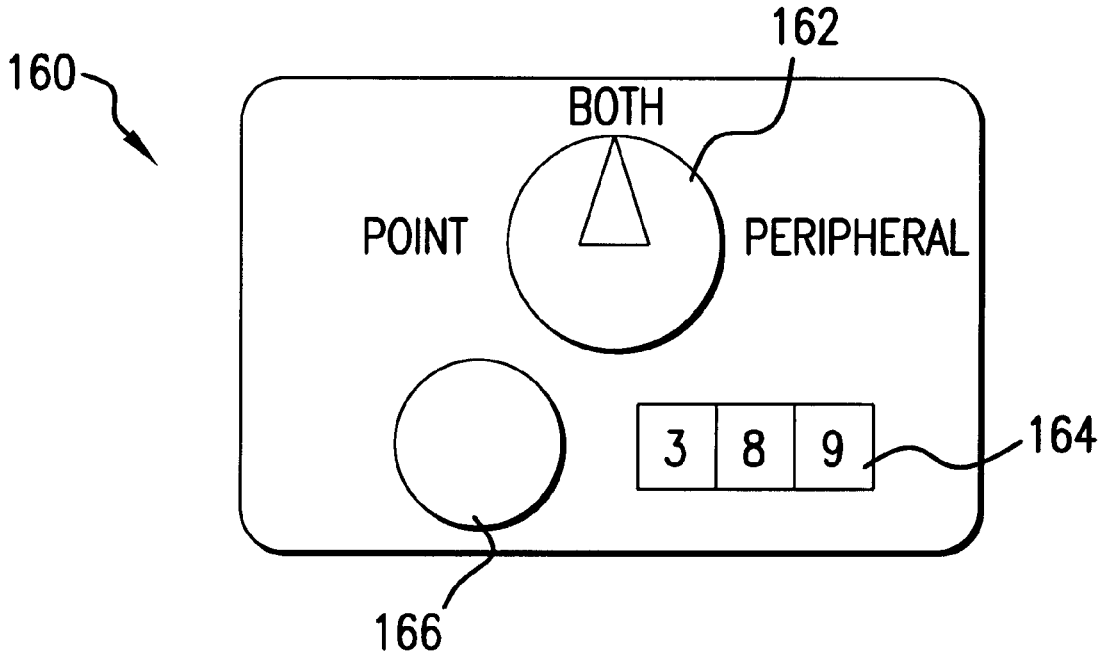

FIG. 25 is a front planar view of a control panel for the device of FIG. 7.

DETAILED DESCRIPTION

Figure 1:
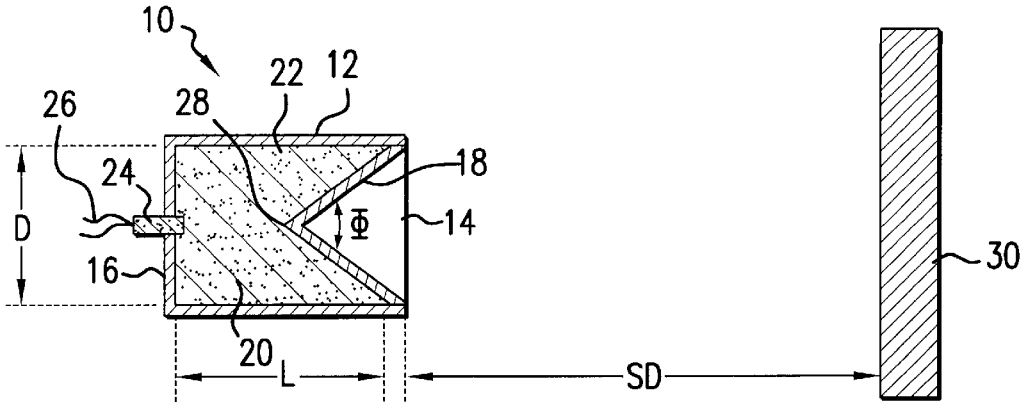
FIG.1 PRIOR ART
FIG. 1 shows in cross-sectional representation a shaped charge device spaced from RHA as known from the prior art.

FIG. 1 illustrates in cross-sectional representation a shaped charge device 10 as known from the prior art. The shaped charge device 10 has a housing 12 with an open end 14 and a closed end 16. Typically, the housing 12 is cylindrical, spherical or spheroidal in shape. A shaped charge liner 18 closes the open end 14 of the housing 12 and in combination with the housing 12 defines an internal cavity 20.

The shaped charge liner 18 is formed from a ductile metal or metal alloy and is typically copper. Other metals that have been disclosed as useful for shaped charge liners include nickel, zinc, aluminum, tantalum, tungsten, depleted uranium, antimony, magnesium and their alloys. The shaped charge liner 18 is usually conical in shape and has a relatively small included angle, $\Phi$. $\Phi$ is typically on the order of 40°–60°. The length, L, of a secondary explosive charge 22 that fills internal cavity 20 is greater than its diameter, D, creating an L/D ratio in excess of 1. A typical L/D ratio is 1.5.

A primary explosive 24, detonatable such as by application of an electric current through wires 26, contacts the secondary explosive 22 adjacent closed end 16 at a point opposite the apex 28 of the shaped charge liner 18.

The shaped charge device 10 is fired when positioned a desired standoff distance, SD, from a target 30. The standoff distance is typically defined as a multiple of the charge diameter, D, and is typically on the order of 3–6 times the charge diameter.

Figure 2:
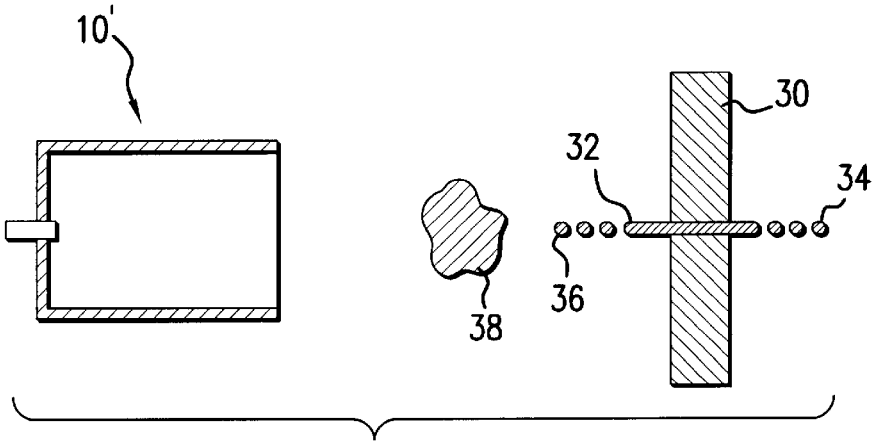
FIG.2 PRIOR ART
FIG. 2 illustrates the shaped charge device of FIG. 1 defeating RHA as known from the prior art.

FIG. 2 illustrates the shaped charge device $\mathbf{10}^1$ following detonation. Detonation of the primary explosive generates a shock wave in the secondary explosive that travels through the secondary explosive collapsing the shaped charge liner and expelling a penetrating jet 32. The penetrating jet 32 is a relatively small diameter, on the order of 2% of the charge diameter, cylinder of liquid metal that travels at very high speeds, on the order of 8 to 10 kilometers per second depending on the sound speed of the liner material. The momentum of the penetrating jet 32 is a function of the mass of the material making up the penetrating jet and the penetrating jet velocity. Such a shaped charge device has proven effective against targets 30 formed from single or multiple layers of rolled homogeneous steel armor.

The speed of the penetrating jet 32 varies from point to point along the length of the jet. This causes the jet to stretch and begin to break up quickly, typically within about 300 microseconds ($300\times10^{-6}$ second) depending on charge diameter, following detonation. Break up typically begins at both the tip 34 and tail 36 of the jet. As individual jet portions achieve trajectory profiles that vary from the profile of the remaining jet body, the jet mass is decreased reducing penetration effectiveness.

Due to liner geometry, the penetrating jet 32 is typically formed from only about 15% of the predetonation liner mass. The remainder of the liner mass forms a slow, 200–300 meters per second, moving slug 38 that trails the penetrating jet 32 and is of generally little value in the defeat of target 30.

Figure 3:
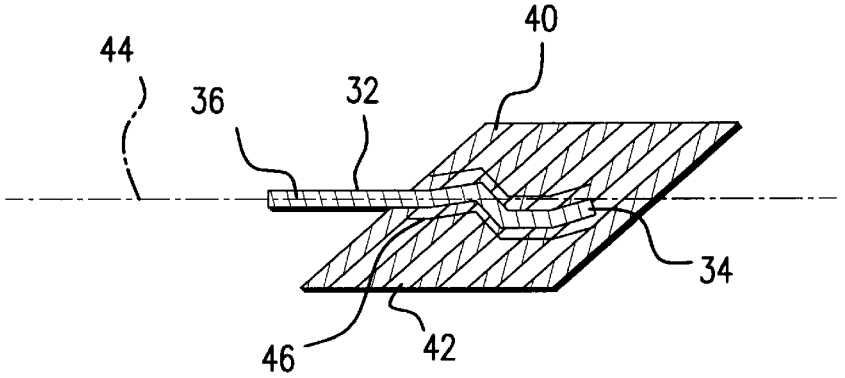
FIG.3 PRIOR ART
FIG. 3 illustrates how angled plates utilizing multiple materials as armor can disrupt a penetrating jet as known from the prior art.

Engineers have redesigned modem armor to defeat penetrating jets. FIG. 3 illustrates one form of modem armor. Multiple armor plates 40 are separated by air gaps 42. The armor plates are aligned at an angle other than normal to the anticipated axis of flight 44 of the penetrating jet 32. As the tip 34 of the penetrating jet impacts an angled armor plate 40, the trajectory is slightly distorted. In addition, shock waves 46 generated during jet penetration are reflected within the air gaps 42. These shock waves effectively disrupt the tail 36 of the penetrating jet 32. The cumulative effect of tip 34 and tail 36 disruption reduces the penetration capability of the jet. It has been determined that the penetration depth of a penetrating jet formed from a 120 mm charge is reduced by up to 2 or 3 times when the target has angled armor with air spaces and multi-material elements, as compared to penetration into conventional RHA. A jet formed from a 150 mm charge typically has a penetration depth reduction of from 65% to 100%.

Figure 4:
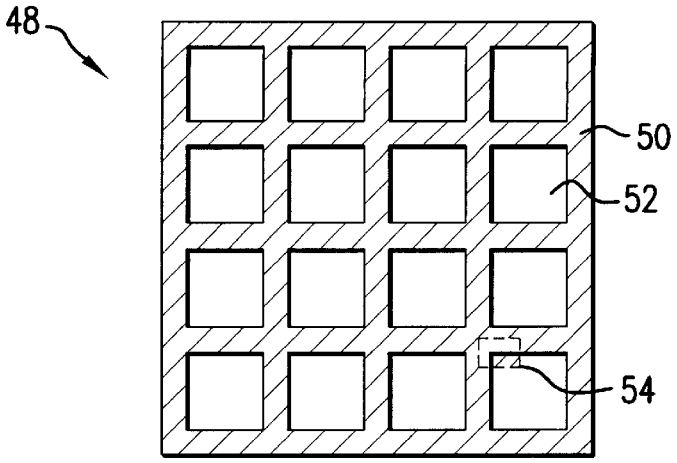
FIG.4 PRIOR ART
FIG. 4 illustrates a radar grid as known from the prior art.

FIG. 4 illustrates a portion of a radar grid 48. The radar grid 48 contains thin metallic beams 50 that are separated by a substantial volume of open space 52. A penetrating jet striking a metallic beam 50 or open space 52 has little, if any, effect on operation of the radar. Only if a vulnerability point 54, such as a portion of the electronics, is impacted will the target be disabled.

Figure 5:
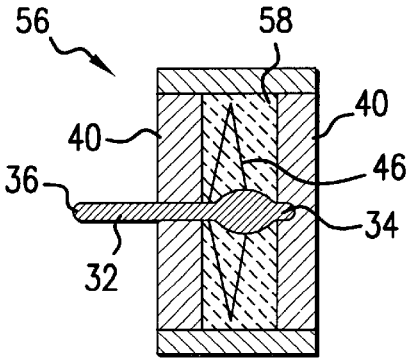
FIG.5 PRIOR ART
FIG. 5 illustrates how one type of composite armor affects a penetrating jet as known from the prior art.

Another modem armor design is composite armor 56 illustrated in FIG. 5. Composite armor has multiple armor plates formed from materials having different mechanical properties, such as different hardnesses and densities. The illustrated composite armor 56 includes RHA armor plates 40 separated by a low density material 58 such as a ceramic, glass or polymeric rubber. Penetrating jet 32 pierces the first armor plate 40 then penetrates the low density material 58. In the low density material, the tip 34 of the jet increases in cross-sectional area and generates shock waves 46 that effectively break up the trailing tail 36 of the penetrating jet 32. The cumulative effect of the composite armor minimizes penetration of the penetrating jet 32 into the target.

Figure 6:
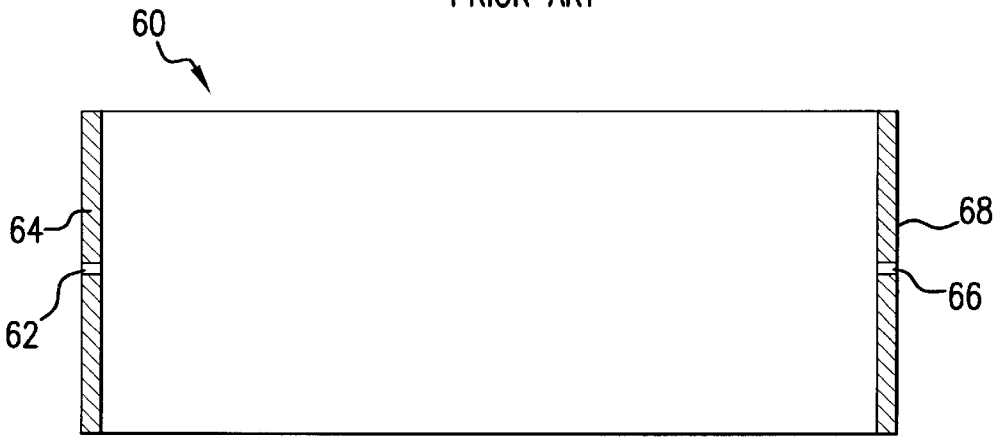
FIG.6 PRIOR ART
FIG. 6 illustrates the ineffectiveness of a penetrating jet against light armor as known from the prior art.

Penetrating jets also have limited effectiveness against lightly armored targets 60 as illustrated in FIG. 6. The penetrating jet pierces 62 a first wall 64 of the lightly armored target, travels through the target and then pierces 66 the second wall 68 exiting the target with minimal damage unless an obstacle was encountered within the lightly armored target.

FIG. 7 illustrates in cross-sectional representation a shaped charge device 70 in accordance with the invention. The shaped charge device 70 is illustrated with a cylindrical housing 72, although other suitable shapes such as spherical or spheroidal may likewise be utilized. The cylindrical housing 72 is typically formed from an aluminum alloy, a composite material or steel. The cylindrical housing has an outside diameter that conforms to a desired caliber weapon, such as 40 millimeters, 105 mm, 120 mm, 125 mm, 150 mm or larger. Typically, the wall thickness of the cylindrical housing 72 is on the order of 2 millimeters.

The cylindrical housing 72 has an open end 74 and a closed end 76. The closed end 76 may be formed from the same material as the cylindrical housing 72 or, to reduce weight, preferably from a low density material such as aluminum, an aluminum alloy or plastic. Closed end 76 may be unitary with the cylindrical housing and formed by milling internal cavity 77 from a solid cylinder. More preferably, the closed end is formed separately from the cylindrical housing and subsequently bonded to the cylindrical housing such as by brazing or by screwing into preformed threads.

A shaped charge liner 78 is formed from any suitable ductile material, such as copper, molybdenum, tantalum, tungsten and alloys thereof. Preferably, the liner is formed from a ductile material having a density above 10 grams per cubic centimeter and most preferably the liner is formed from molybdenum (density 10.4 gm/cm$^3$) or a molybdenum alloy. The shaped charge liner 78 has an included angle o that is greater than 70° and preferably between about 75° and 120° and most preferably between about 75° and 90°. A nominal value for ø is 80°. The sidewalls of the shaped charge liner 78 are generally arcuate such that the preferred shaped charge liner is generally tulip shaped although other known shapes such as trumpet and conical may be utilized depending on the armor hole profile desired.

A secondary explosive 80 fills the internal cavity 77 defined by the cylindrical housing 72, the closed end 76 and the shaped charge liner 78. Typically, there is about 900–1200 grams of secondary explosive for a 120 mm diameter charge. An exemplary explosive is LX-14 (plastic bonded HMX (octahydro-1,3,5,7-tetranitro-1,3,5,7-tetrazocine), Mason & Hanger Corp., Pantex Plant, Amarillo, Tex.).

Detonator 82 contacts the secondary explosive 80 through the closed end 76. The detonator 82 has multiple, and preferably three, separate outputs. Each output is capable of generating a primer flash when actuated. A first output 84 is effective to cause the shaped charge device 70 to form a penetrating jet following detonation. A second output 86 is effective to cause the shaped charge device to form an explosively formed penetrator following detonation. A combination of the second output 86 and a third output 88 is effective to cause the shaped charge device to form multiple fragments following detonation.

An initiating signal, such as an electrical signal, transmitted through wires 90 determines which outputs (84,86, 88) of the detonator 82 are actuated.

Figure 8:
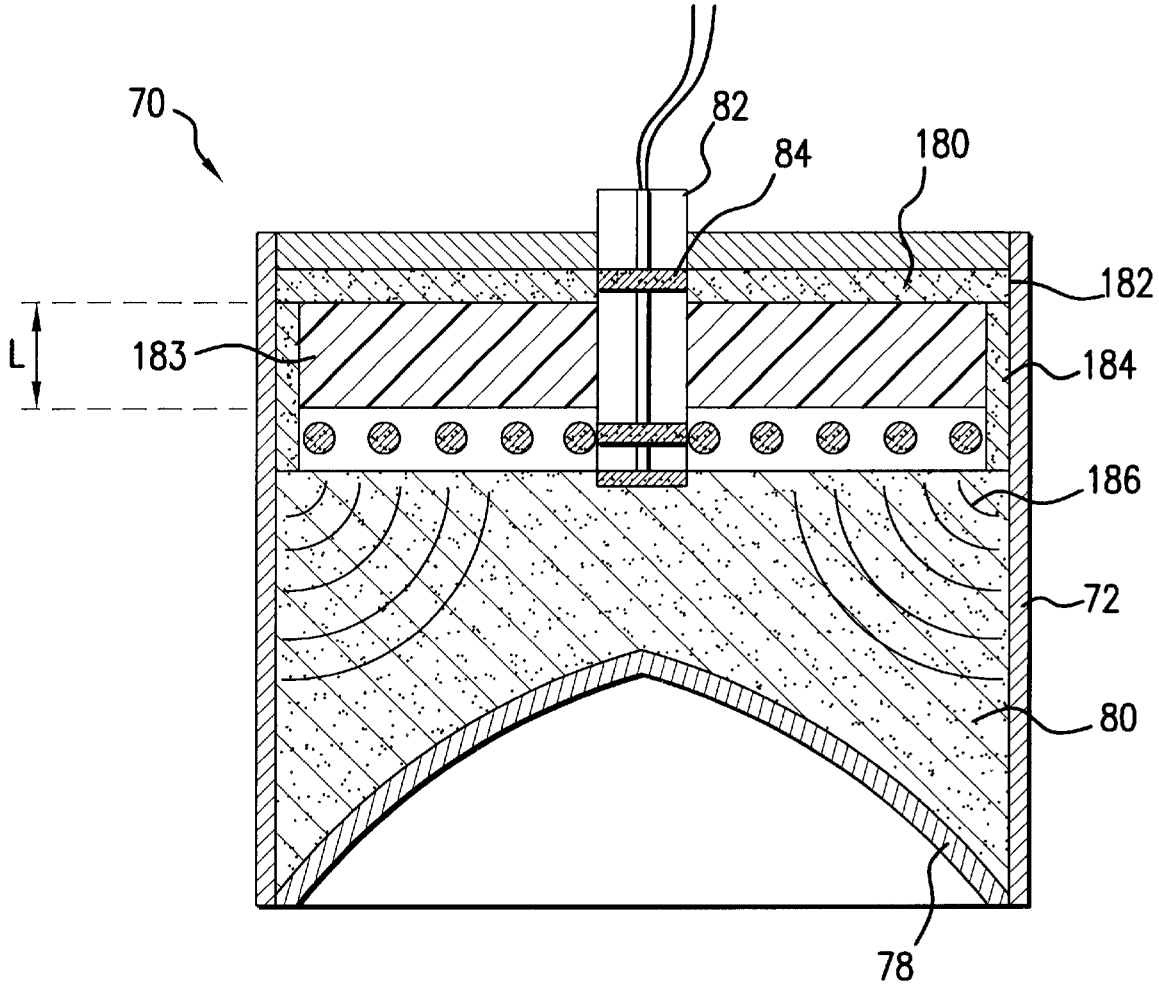
FIG. 8 illustrates the start of the formation process for a penetrating jet from the shaped charge device of FIG. 7.

FIG. 8 illustrates the shaped charge device 70 when the first output 84 of detonator 82 is actuated. Actuation generates an explosive shock wave that travels through a disk 180 of a suitable explosive, such as a plastic bonded explosive (PBX), to an inner perimeter 182 of the cylindrical housing 72. A wave shaper 183 formed from a material that transmits shock waves at a slower speed than the explosive disk directs the shock wave to the inner perimeter 182. An exemplary material for wave shaper 183 is a polymer foam. Wave shaper width, L, is, at a minimum, that effective to prevent premature initiation of the secondary explosive 80.

The shock wave travels through an initiation tube 184 that may be any suitable PBX and is transmitted to secondary explosive 80. Peripheral shock waves 186 converge on the shaped charge liner 78 collapsing the liner and expelling a penetrating jet.

Figure 9:
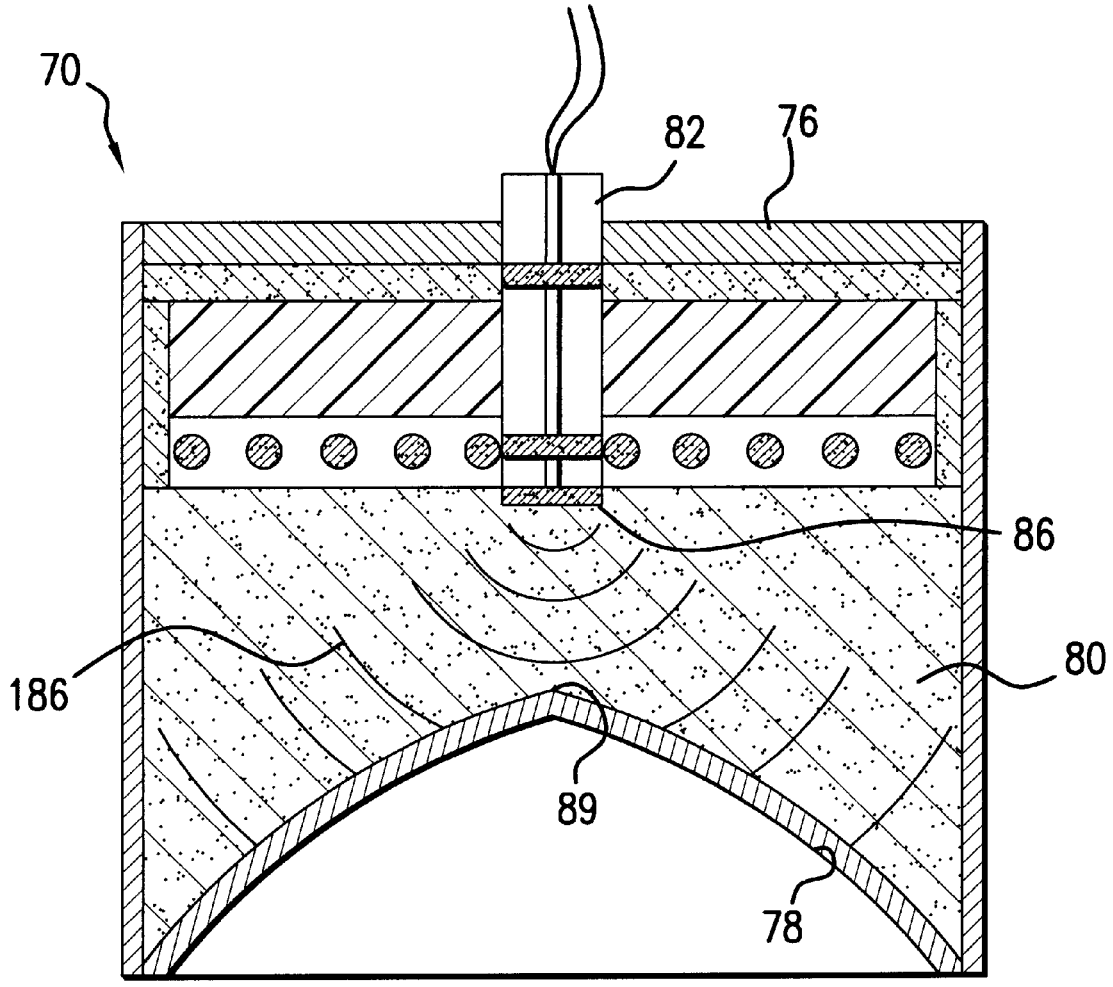
FIG. 9 illustrates the start of the formation process for an explosively formed penetrator from the shaped charge device of FIG. 7.

FIG. 9 illustrates the shaped charge device 70 when the second output 86 of detonator 82 is actuated. The second output 86 is centrally disposed on the closed end 76 and aligned with the apex 89 of the shaped charge liner 78. Actuation generates an explosive shock wave 186 that travels through the secondary explosive 80 and diverges about the shaped charge liner 78 collapsing the liner and expelling an explosively formed penetrator.

Figure 10:
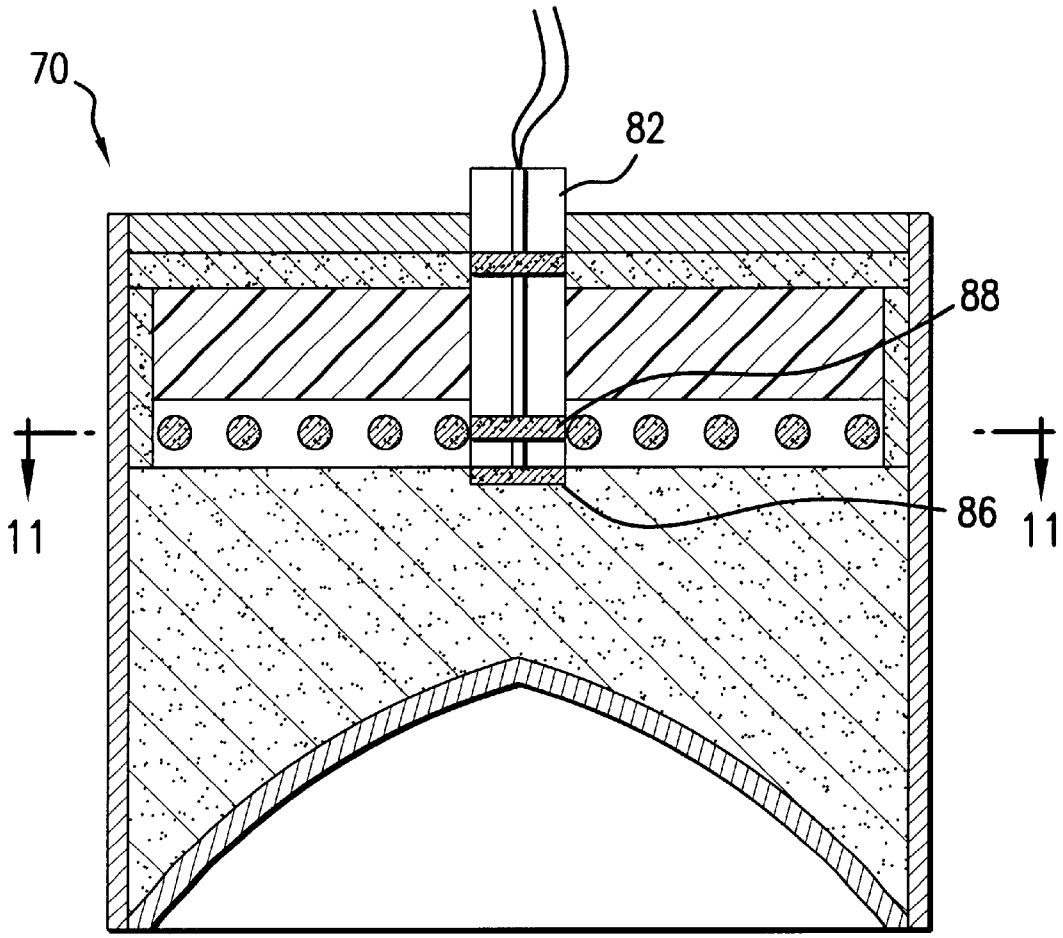
FIG. 10 illustrates the start of the formation process for a multiple fragments from the shaped charge device of FIG. 7.
Figure 11:
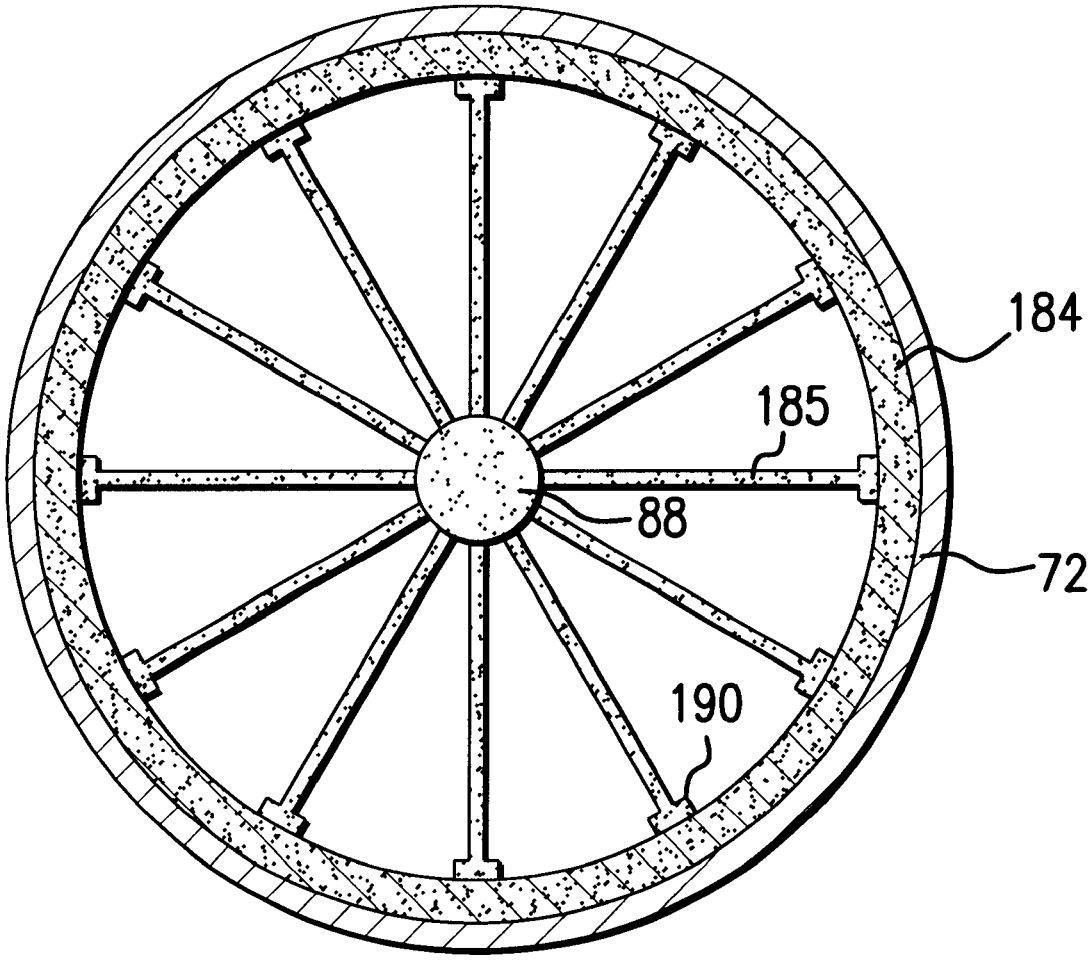
FIG. 11 illustrates a initiation arrangement effective to generate multiple fragments.

FIG. 10 illustrates the shaped charge device 70 when the second output 86 and third output 88 of detonator 82 are actuated at substantially the same time. Referring to FIG. 11, third output 88 is centrally disposed from a plurality of initiation pellets 190 that are supported by the initiation tube 184. Initiation pellets may be any suitable explosive such as RDX (1,3,5-trinitro-1,3,5-triazacyclohexane). A plurality of initiation pellets are symmetrically disposed around the third output 88. Preferably, there are a minimum of eight symmetrically disposed initiation pellets for effective generation of multiple fragments. More preferably, there are between 8 and 16 symmetrically disposed initiation pellets. Third output 88 communicates with the initiation pellets 190 through detonation spokes 185 that may be formed from any suitable explosive. Preferably, detonation spokes 185 are formed from a plastic bonded explosive.

Substantially simultaneous actuation of the second output 86 and the third output 88 produces interacting shock waves, referred to as a Mach stem, that fractures the shaped charge liner 78 into as many penetrator fragments as there are initiation pellets.

While a continuous peripheral detonation ring and a wave shaper is used for long stretching jets, multiple discrete detonation points are preferred for the generation of penetrator fragments.

With reference back to FIG. 7, the secondary explosive 80 contained in shaped charge device 70 preferably has a diameter, D, that is greater than the length, L, such that the ratio L/D is at most 1 and more preferably less than 1. This compares to conventional L/D ratios of between 1.5 and 1.8. Preferably, L/D is from about 0.5 to about 0.9 and more preferably L/D is about 0.8.

FIG. 25 illustrates in front planar view a control panel 160 for use with the shaped charge warhead of FIG. 7. The type of detonation is selected 162 to be peripheral to form a penetrating jet, point to form an EFP or both to form multiple fragments. The distance 164 to the target is selected 166 so that detonation electronics (not shown) may initiate detonation an effective number of charge diameters from the target. Alternatively, a proximity sensor may initiate detonation at the proper distance from the target.

Table 1 illustrates that the benefit achieved by reducing the charge length. A smaller, lighter, more transportable warhead, outweighs the loss in penetration depth. Table 1 was generated using a CALE calculation. CALE is a shaped charge jet prediction and design hydrocode developed by Lawrence Livermore National Laboratory, Livermore, California. Comparing designs 1 and 3, it is shown that a 24% reduction in the charge length resulted in a 15% loss in penetration depth. This illustrates that with the device illustrated in FIG. 7, L/D ratios of 0.5 to 0.6 can be made without a significant loss in penetration performance.

TABLE 1

| Design | L/D Ratio | % of Charge Length | % Reduction in Length | Calculated Relative Penetration | % Loss in Penetration v. Reduction |
|---|---|---|---|---|---|
| 1 | 0.710 | 100% | 0% | 1.00 mm | 0% |
| 2 | 0.620 | 90% | 13% | 0.97 mm | 3.5% |
| 3 | 0.543 | 80% | 24% | 0.85 mm | 15% |
| 4* | 0.543 | 80% | 24% | 0.83 mm | 17% |

*Liner changed from Design 3 to Design 4.

FIG. 12*a* illustrates a penetrating jet projectile 91 obtained by actuating the first output 84 illustrated in FIG. 7 to initiate peripheral detonation. FIG. 13 graphically illustrates the predictive velocity distribution 92 and predictive mass distribution 94 of the penetrating jet 91. The tip velocity 96 is in excess of 7 kilometers per second and the tail velocity is arbitrarily set at 2 km./sec. Any mass with a velocity of less than a cut-off velocity 98 of 2 km./sec. forms slug mass 100 that is shown to be less than 15% of the predetonation liner mass.

The high tail velocity and small slug mass, as compared to conventionally formed penetrating jets, allows the shaped charge device of FIG. 7 to also be used as a precursor charge for a trailing penetrating jet. The precursor charge is tandemly aligned on the same axis as the trailing main charge. Unlike tandem systems with large, slow precursor jets, the jet tip of the trailing main charge will not overcome the tail of the precursor. As a result, the precursor need not be placed off-center from the main charge thereby avoiding the problems of offset precursor charges such as shock waves that may cause main charge component rotation.

FIG. 14 is an x-ray image of a 120 mm diameter penetrating jet 91 formed from the device of FIG. 7 as a function of time. The image was formed by three separate x-ray imaging machines triggered at three separate times. As illustrated, the jet maintains coherency over a substantial portion of its length for in excess of 250 microseconds and the tail 36 retains coherency for an extended period of time. The durability of the tail makes the penetrating jet 91 of the invention particularly useful for defeating composite armor. Maximizing momentum, by maintaining jet coherency, and maintaining tail coherency against shock waves increases the effectiveness of the jet against composite armor. Further maximizing momentum is the increased penetrating jet mass because typically between 85% and 90%, by weight, of the liner mass goes into the penetrating portion of the jet.

FIG. 12*b* illustrates an explosively formed penetrator (EFP) 102 formed by detonation of second output 86 of FIG. 7. As compared to the penetrating jet 91 of FIG. 12*a*, the explosively formed penetrator 102 has a larger diameter and slower velocity. This type of projectile is particularly useful against lightly armored targets such as troop carriers. Typically, an explosively formed penetrator has a length that is from 0.5 to 2 times the charge diameter. The x-ray image in FIG. 15, illustrates the explosively formed penetrator 102 has an EFP maximum tip 103 speed of about 4.5 kilometers per second and an EFP coherent tip 104 speed on the order of 4.2 kilometers per second. The EFP tail 106 speed is about 2.5 kilometers per second and a small portion of the predetonation liner mass forms a trailing slug.

Substantially simultaneous (within a few microseconds) actuation of both the second output 86 and third output 88 illustrated in FIG. 7 generates multiple fragments 108 as illustrated in FIG. 12*c*. To assure uniform flight of the multiple fragments along a common axis, the initiation pellets are symmetrically disposed about an axis extending through the apex of the shaped charge liner and initiate detonation of the primary explosive at substantially the same time. All initiation pellets should initiate point detonation of the primary explosive within about 6 to 10 microseconds of each other.

Multiple fragments 108 are useful against a target having limited points of vulnerability, such as a radar grid or similar installation. Firing multiple fragments increases the likelihood that at least one projectile will impact a vulnerable point of the target, such as electronics or hydraulics.

A composite liner 110 may be utilized with the shaped charge device 112 of the invention as illustrated in FIG. 16. The composite liner 1 10 includes a jet forming component 114 formed from a suitable liner material such as copper, molybdenum, tantalum, tungsten, silver and their alloys. The jet forming component is on the concave side of the liner, not in contact with the secondary explosive 80. An effect forming component 116 forms the convex surface of the composite liner 110 and contacts the secondary explosive 80. The effect forming component 116 may be an incendiary such as zirconium or magnesium that is bonded to the jet forming component 114 such as by gluing, cladding, electrolytic or electroless deposition or vapor deposition. On detonation, the composite liner 110 is collapsed forming a penetrating jet 118 trailed by a slower-moving effect follow-through 120 as illustrated in FIG. 17. The effect follow-through 120 trails the penetrating jet 118 at a speed of from about 2 to 5 kilometers per second and passes through the hole formed by the penetrating jet.

The advantages of the invention will become more apparent from the examples that follow.

EXAMPLES

Example 1

FIG. 18 compares a prior art shaped charge device 10 for a 120 millimeter charge with an equivalent shaped charge device 70 of the invention. A substantial reduction in both size and weight was achieved while also obtaining superior performance especially against modern composite armor. The conventional shaped charge device 10 was packed with 1720 grams of LX-14 as primary explosive and utilized a 620 gram copper liner. The included angle was an average of 42°, i.e., a trumpet shaped liner.

The equivalent shaped charge device of the invention 70 was packed with between 1115 grams and 1140 grams of LX-14 as a primary explosive and utilized 320–340 grams of a molybdenum liner having an included angle of 80°.

Detonation of the conventional shaped charge liner 10 generated a penetrating jet with only 15% of the liner mass having a velocity in excess of 2 kilometers per second 122 and useful as the penetrating jet with a tip velocity of 9.8 kilometers per second. The remaining 85% of the liner mass constituted a slow, 200–300 meters per second, trailing slug 124.

Detonation of the equivalent shaped charge device 70 of the invention generated a penetrating liner in which 85% of the liner mass had a velocity in excess of 2 kilometers per second 126 and was useful as a penetrating jet with a tip velocity of 12.5 kilometers per second. Only 15% of the liner mass formed the penetrating slug 128 at 1.5 kilometers per second.

The penetrating jet formed from the shaped charge device 70 of the invention penetrated deeper into RHA, to a depth of about 970 millimeters 130, compared to a depth of about 850 millimeters 132 for the conventional penetrating jet. In addition, there was more uniformity of hole diameter. Hole diameter uniformity is beneficial because it demonstrates that the jet energy distribution in the penetrating jet was uniform and maximizes penetration.

Example 2

FIG. 19 is an x-ray image of a 120 millimeter diameter charge having a single point source detonation utilizing the shaped charge liner of the invention. A coherent jet 134 was formed that maintains substantial coherency for at least 225 microseconds. This jet is useful to form a large hole in a soft target.

FIG. 20 is an x-ray image for a 106 millimeter nominal charge diameter shaped charge device of the invention following peripheral detonation. A long, small diameter penetrating jet 136 was formed that maintained substantial coherency for at least 165 microseconds and even following break up maintains an ordered array of particles 138 for up to about 200 microseconds. Break up was initiated at the tip 140 of the penetrating jet 136 maintaining a more continuous robust tail 142 with increased mass to better defeat composite and other types of reactive armor.

Example 3

FIG. 21 graphically illustrates the projectile profile 144 for a point source initiated explosively formed penetrator formed from the shaped charge device of the invention while FIG. 22 plots a velocity profile 146 for the same penetrator as calculated utilizing CALE analysis. The analysis indicates that the explosively formed penetrator has the length, L, of about two charge diameters and an effective thickness of about 0.25 times the charge diameter. A substantial portion 148 of the penetrator mass has the velocity in excess of 2 kilometers per second.

Example 4

FIG. 23 illustrates the penetrating jet profile 150 for a penetrating jet formed by peripheral initiation of the shaped charge device of the invention while FIG. 24 is a velocity profile 152 as generated by CALE analysis. The penetrating jet has a length, L, of about 3 charge diameters, a maximum tip velocity in excess of 8 kilometers per second and substantially all of the liner mass has the velocity in excess of 2 kilometers per second indicating that substantially all the liner mass goes into the penetrating jet and not the trailing slug.

It is apparent that there has been provided in accordance with this invention a shaped charge liner that fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A multipurpose charge for a warhead, comprising:

a housing having an open end and a closed end with sidewalls disposed therebetween;

a jet producing liner closing said open end;

said housing and said jet producing liner defining an internal cavity;

a primary explosive disposed within said internal cavity; and a detonator in combination with an initiating explosive effective for selectively initiating detonation of said primary explosive by peripheral detonation, central point detonation, peripheral point detonation and combinations thereof wherein a disc is disposed about a perimeter of said internal cavity, said disc being effective to enable peripheral detonation.

2. The multipurpose charge for a warhead of claim 1 wherein said primary explosive has a shape selected from the group consisting of substantially cylindrical and substantially spherical with a length L, to diameter, D, ratio L/D of less than 1.3.

3. The multipurpose charge for a warhead of claim 2 wherein said L/D ratio is between 0.5 and 1.2.

4. The multipurpose charge for a warhead of claim 3 wherein said L/D ratio is between 0.6 and 1.0.

5. The multipurpose charge for a warhead of claim 3 wherein said jet producing liner has a shape selected from the group consisting of tulip, trumpet and conical and an included angle of at least 70°.

6. The multipurpose charge for a warhead of claim 5 wherein said jet producing liner is formed from a material selected from the group consisting of copper, molybdenum, tantalum, tungsten, silver and alloys thereof.

7. A multipurpose charge for a warhead, comprising:

a housing having an open end and a closed end with sidewalls disposed therebetween;

a jet producing liner closing said open end;

said housing and said jet producing liner defining an internal cavity;

a primary explosive disposed within said internal cavity;

a detonator in combination with an initiating explosive effective for selectively initiating detonation of said primary explosive by peripheral detonation, central point detonation, peripheral point detonation and combinations thereof, wherein said peripheral detonation comprises between 8 and 16 discrete detonation points symmetrically disposed about a perimeter of said primary explosive.

8. The multipurpose charge for a warhead of claim 7 wherein said primary explosive has a shape selected from the group consisting of substantially cylindrical and substantially spherical with a length L, to diameter, D, ratio L/D of less than 1.3.

9. The multipurpose charge for a warhead of claim 8 wherein said L/D ratio is between 0.5 and 1.2.

10. The multipurpose charge for a warhead of claim 9 wherein said L/D ratio is between 0.6 and 1.0.

11. A multipurpose charge for a warhead, comprising:

a housing having an open end and a closed end with sidewalls disposed therebetween;

a jet producing liner having shape selected from the group consisting of tulip, trumpet and conical and having an included angle of at least 70° closing said open end;

said housing and said jet producing liner defining an internal cavity;

a primary explosive disposed within said internal cavity;

a detonator in combination with an initiating explosive effective for selectively initiating detonation of said primary explosive by peripheral detonation, central point detonation, peripheral point detonation and combinations thereof.

12. The multipurpose charge for a warhead of claim 11 wherein said primary explosive has a shape selected from the group consisting of substantially cylindrical and substantially spherical with a length L, to diameter, D, ratio L/D of less than 1.3.

13. The multipurpose charge for a warhead of claim 12 wherein said L/D ratio is between 0.5 and 1.2.

14. The multipurpose charge for a warhead of claim 13 wherein said included angle is between 75° and 120°.

15. The multipurpose charge for a warhead of claim 14 wherein said included angle is between 75° and 90°.

16. The multipurpose charge for a warhead of claim 14 wherein said jet producing liner is tulip shaped.

17. The multipurpose charge for a warhead of claim 14 wherein said jet producing liner is formed from a material selected from the group consisting of copper, molybdenum, tantalum, tungsten, silver and alloys thereof.

18. The multipurpose charge for a warhead of claim 11 wherein said jet producing liner has a minimum density of 10 grams per cubic centimeter.

19. The multipurpose charge for a warhead of claim 12 wherein said jet producing liner is formed from molybdenum or a molybdenum alloy.

20. The multipurpose charge for a warhead of claim 19 wherein a control panel activates a desired detonation type.

21. The multipurpose charge for a warhead of claim 14 wherein said jet producing liner is a composite material.

22. The multipurpose charge for a warhead of claim 21 wherein said jet producing liner is a composite material having a jet forming portion and an effect forming portion.

23. The multipurpose charge for a warhead of claim 22 further including a wave shaper effective to facilitate peripheral detonation of said explosive.

* * * * *